US011183017B1

(12) United States Patent
Tsai et al.

(10) Patent No.: US 11,183,017 B1
(45) Date of Patent: Nov. 23, 2021

(54) APPARATUS AND METHOD FOR DETECTING A WON PRIZE IN A CLAW MACHINE

(71) Applicant: Feiloli Electronic Co., Ltd., Hemei Town (TW)

(72) Inventors: Chi-Ming Tsai, Hemei Town (TW); I-Chiang Yang, Hemei Town (TW)

(73) Assignee: Feiloli Electronic Co., Ltd., Hemei Town (TW)

( * ) Notice: Subject to any disclaimer, the term of this patent is extended or adjusted under 35 U.S.C. 154(b) by 0 days.

(21) Appl. No.: 17/143,304

(22) Filed: Jan. 7, 2021

(51) Int. Cl.
*A63F 9/30* (2006.01)
*G07F 17/32* (2006.01)

(52) U.S. Cl.
CPC ..... *G07F 17/3253* (2013.01); *A63F 9/30* (2013.01); *G07F 17/3223* (2013.01)

(58) Field of Classification Search
CPC .... G07F 17/3253; G07F 17/3223; A63F 9/30; A63F 13/90; A63F 2300/1043
USPC ..... 463/16
See application file for complete search history.

(56) References Cited

U.S. PATENT DOCUMENTS 5,711,530 A * 1/1998 Lewis ..... A63F 9/30 273/448
5,967,892 A * 10/1999 Shoemaker, Jr. ..... A63F 9/24 273/448
7,334,798 B2 * 2/2008 Halliburton ..... A63F 9/00 273/447
7,918,458 B2 * 4/2011 Fukazawa ..... A63F 9/305 273/448
2006/0149415 A1 * 7/2006 Richards ..... G07F 9/002 700/236
2009/0191931 A1 * 7/2009 Peck ..... G07F 17/32 463/7

FOREIGN PATENT DOCUMENTS

CN 206285476 U 6/2017
CN 206688205 U 12/2017
CN 207562326 U 7/2018

* cited by examiner

*Primary Examiner* — Allen Chan
(74) *Attorney, Agent, or Firm* — Alan D. Kamrath; Karin L. Williams; Mayer & Williams PC

(57) ABSTRACT

A claw machine includes a chute and a sensor for detecting a won prize dropped to the chute. The sensor includes infrared units, a comparator, a calculating and judging unit, an actuating unit, an indicator, a controller, an integrated circuit board and a casing. Each of the infrared units includes an infrared transmitter for emitting an incident infrared beam with a carrier wave at a predetermined frequency and an infrared receiver for receiving a reflected infrared beam at the predetermined frequency. The controller instructs, controls, commands and manages the infrared units, the comparator, the calculating and judging unit, the actuating unit and the indicator. The infrared units, the comparator, the calculating and judging unit, the actuating unit and the indicator are supported on the integrated circuit board. The casing contains the integrated circuit board. The casing, which contains the integrated circuit board, is supported on a wall of the chute.

5 Claims, 11 Drawing Sheets

APPARATUS AND METHOD FOR DETECTING A WON PRIZE IN A CLAW MACHINE

BACKGROUND OF INVENTION

1. Field of Invention

The present invention relates to a game machine and, more particularly, to an apparatus and method for detecting a won prize in a claw machine.

2. Related Prior Art

A typical claw machine includes a booth, a crane, a claw, a coin module and a maneuver module. Multiple prizes are located in the booth. A player inserts at least one coin into the coin module to actuate the maneuver module, the crane and the claw in a limited period of time. In this limited period of time, the user uses the maneuver module to move the crane and the claw to grasp one (the "won prize") of the prizes and then drop the won prize onto a chute that delivers the won prize out of the booth.

To determine whether the won prize travels from the booth via the chute, a sensor is often located in the vicinity of the chute. The sensor detects the won prize, which travels through the chute.

CN206285476U discloses a transmitter 5 and a corresponding receiver 9, both located in a feeder 10. The transmitter 5 transmits an infrared or photoelectric signal to the receiver 9. The transmission of the signal is interrupted when a prize travels through the feeder 10. Hence, a gate is opened to allow a player to obtain the prize.

CN206688205U discloses an infrared sensor 11 located on a wall of a chute 8. A joystick 6 is operated to move a claw 4 to grasp and then drop a prize to the chute 8. The infrared sensor 11 detects the prize and accordingly sends a signal to a controller 12. On receiving the signal, the controller 12 extends a countdown by ten seconds as an incentive.

CN207562326 disclose an infrared sensor 11 located on a wall of a chute 10. A joystick 7 and a controller 8 are in communication of signals with the infrared sensor 11. The joystick 7 is operated to move a claw 4 to grasp a prize and then drop the prize to the chute 10. The infrared sensor 11 detects the prize and accordingly sends a signal to the controller 8. On receiving the signal, the controller 8 terminates the operation.

In each of the above-mentioned devices, the infrared sensor is located in the chute to detect a prize and accordingly send a signal to the controller. The controller executes various tasks. However, the chutes are of various sizes, and so are the prizes. According to the various sizes of the chutes, the infrared sensors have to be adjusted to emit an infrared beam of various values of intensity to render the detection of the prize accurate. A knob is turned to adjust the intensity of the infrared beam. This practice is time-consuming and inaccurate. Moreover, various lights are often used in the devices to increase the effects of entertainment. However, such lights cause the infrared sensors to misjudge.

The present invention is therefore intended to obviate or at least alleviate the problems encountered in the prior art.

SUMMARY OF INVENTION

It is the primary objective of the present invention to provide a claw machine with a chute and a sensor for detecting a won prize dropped to the chute.

To achieve the foregoing objective, the sensor includes infrared units, a comparator, a calculating and judging unit, an actuating unit, an indicator, a controller, an integrated circuit board and a casing. Each of the infrared units includes an infrared transmitter for emitting an incident infrared beam with a carrier wave at a predetermined frequency and an infrared receiver for receiving a reflected infrared beam at the predetermined frequency. The actuating unit includes a button. The indicator emits light of various colors in various ways. The controller instructs, controls, commands and manages the infrared units, the comparator, the calculating and judging unit, the actuating unit and the indicator. The infrared units, the comparator, the calculating and judging unit, the actuating unit and the indicator are supported on the integrated circuit board. The casing contains the integrated circuit board. The casing includes a front panel connected to a back plate. The front panel includes apertures for receiving the infrared units. The button of the actuating unit is exposed from the casing via the back plate. The casing, which contains the integrated circuit board, is supported on a wall of the chute.

Other objectives, advantages and features of the present invention will be apparent from the following description referring to the attached drawings.

BRIEF DESCRIPTION OF DRAWINGS

The present invention will be described via detailed illustration of the preferred embodiment referring to the drawings wherein.

DETAILED DESCRIPTION OF PREFERRED EMBODIMENT

Figure 1:
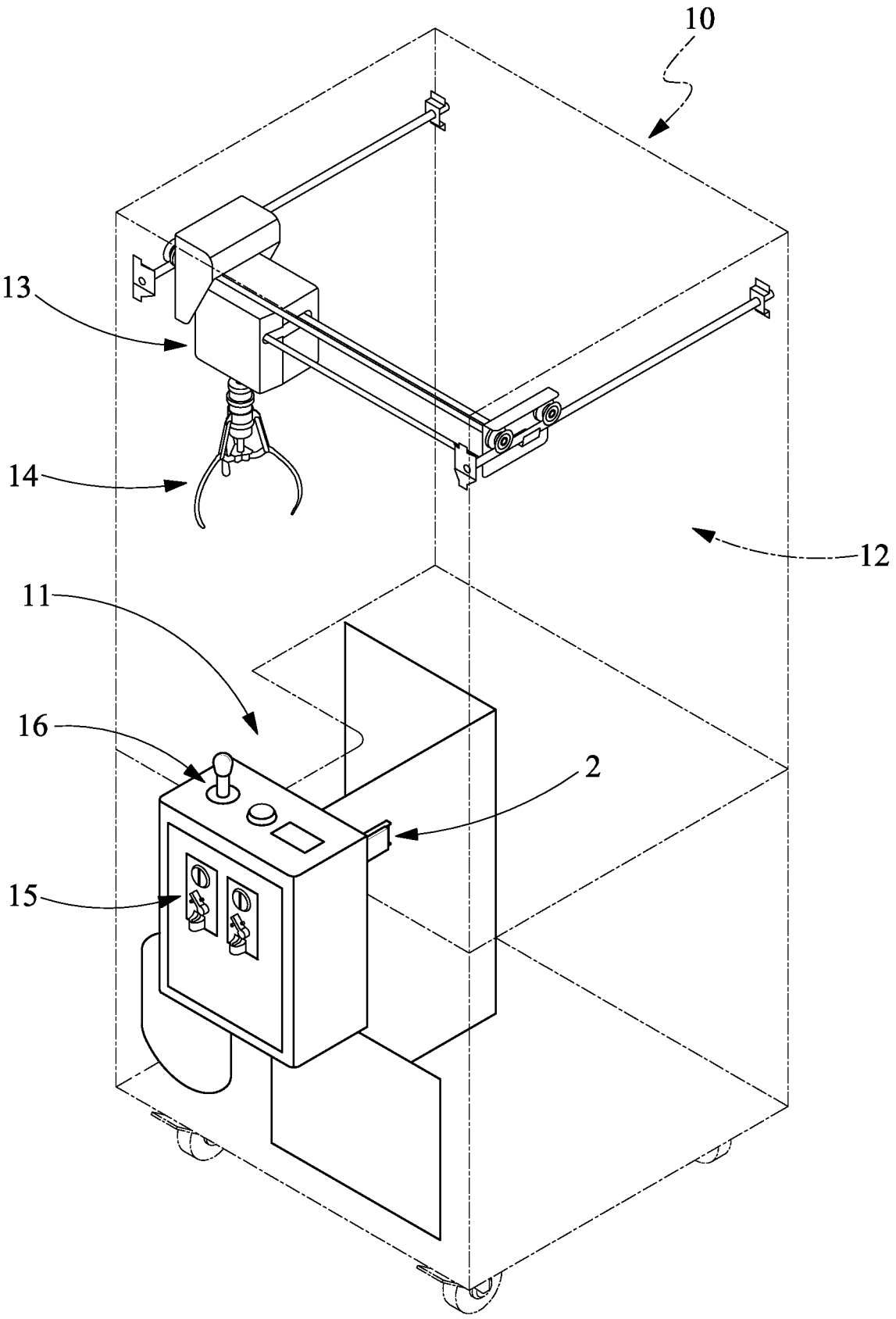
FIG. 1 is a front perspective view of a claw machine equipped with an apparatus for detecting a won prize according to the preferred embodiment of the present invention.
Figure 2:
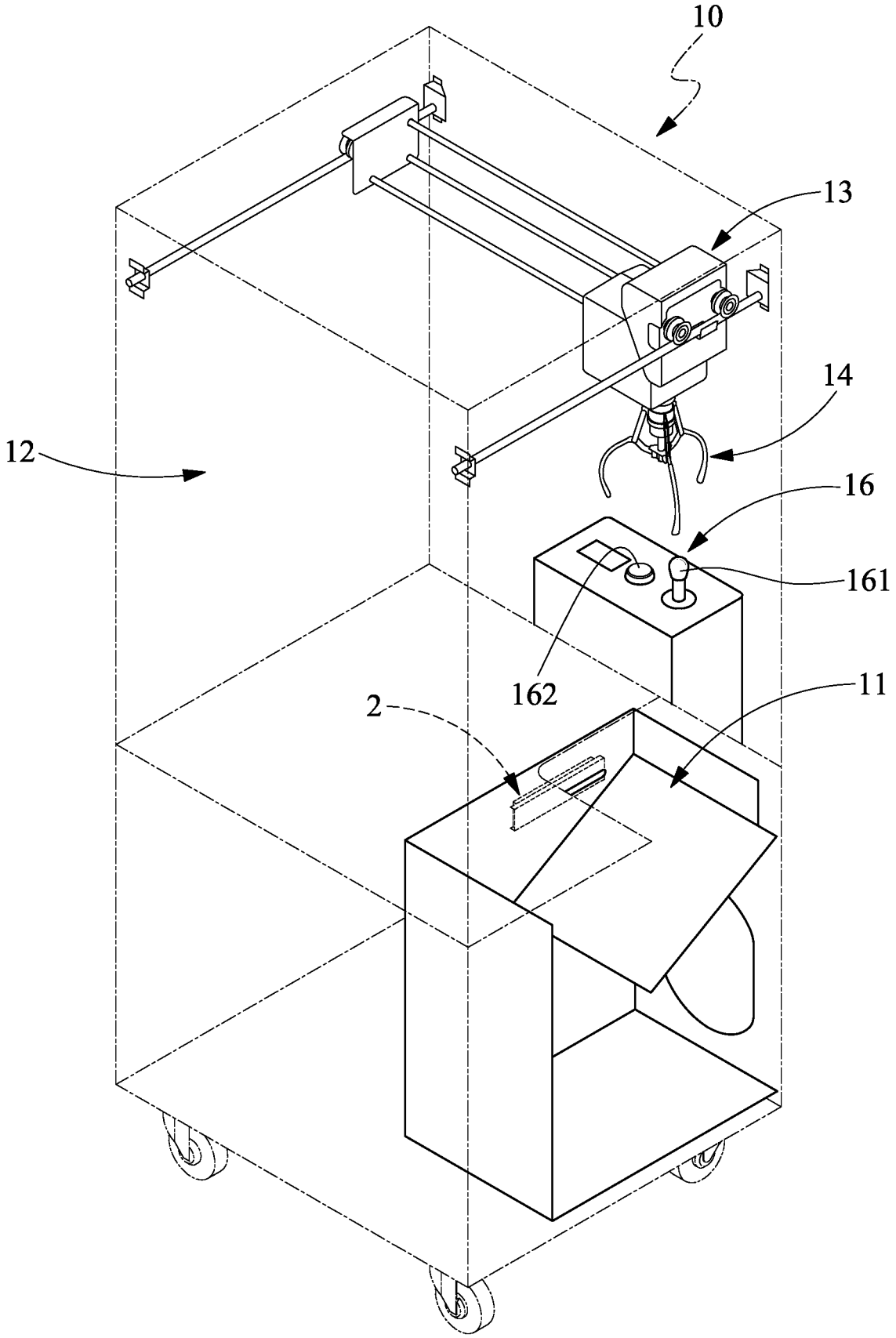
FIG. 2 is a rear perspective view of the claw machine shown in FIG. 1.
Figure 3:
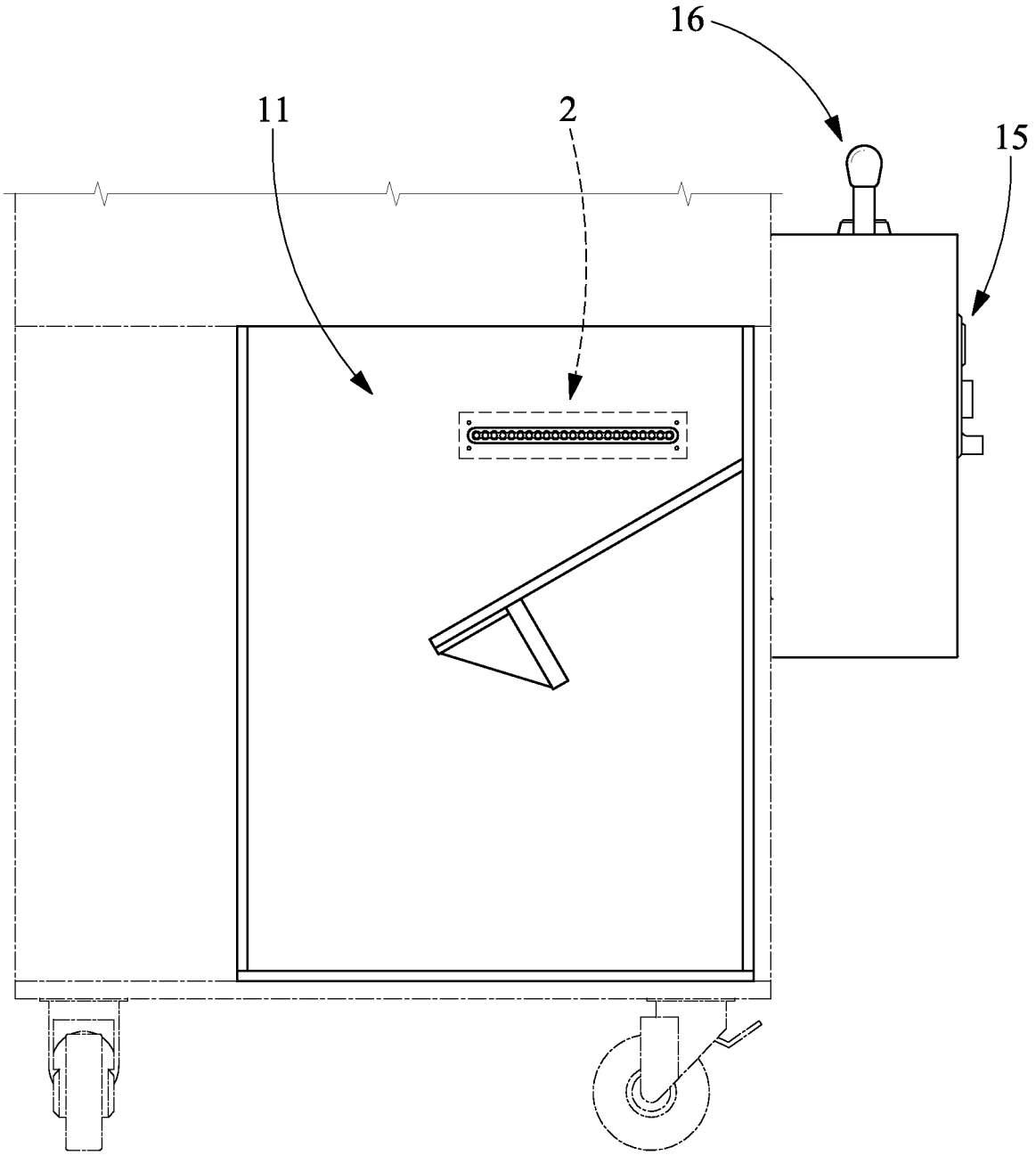
FIG. 3 is a left side view of the claw machine shown in FIG. 1.
Figure 4:
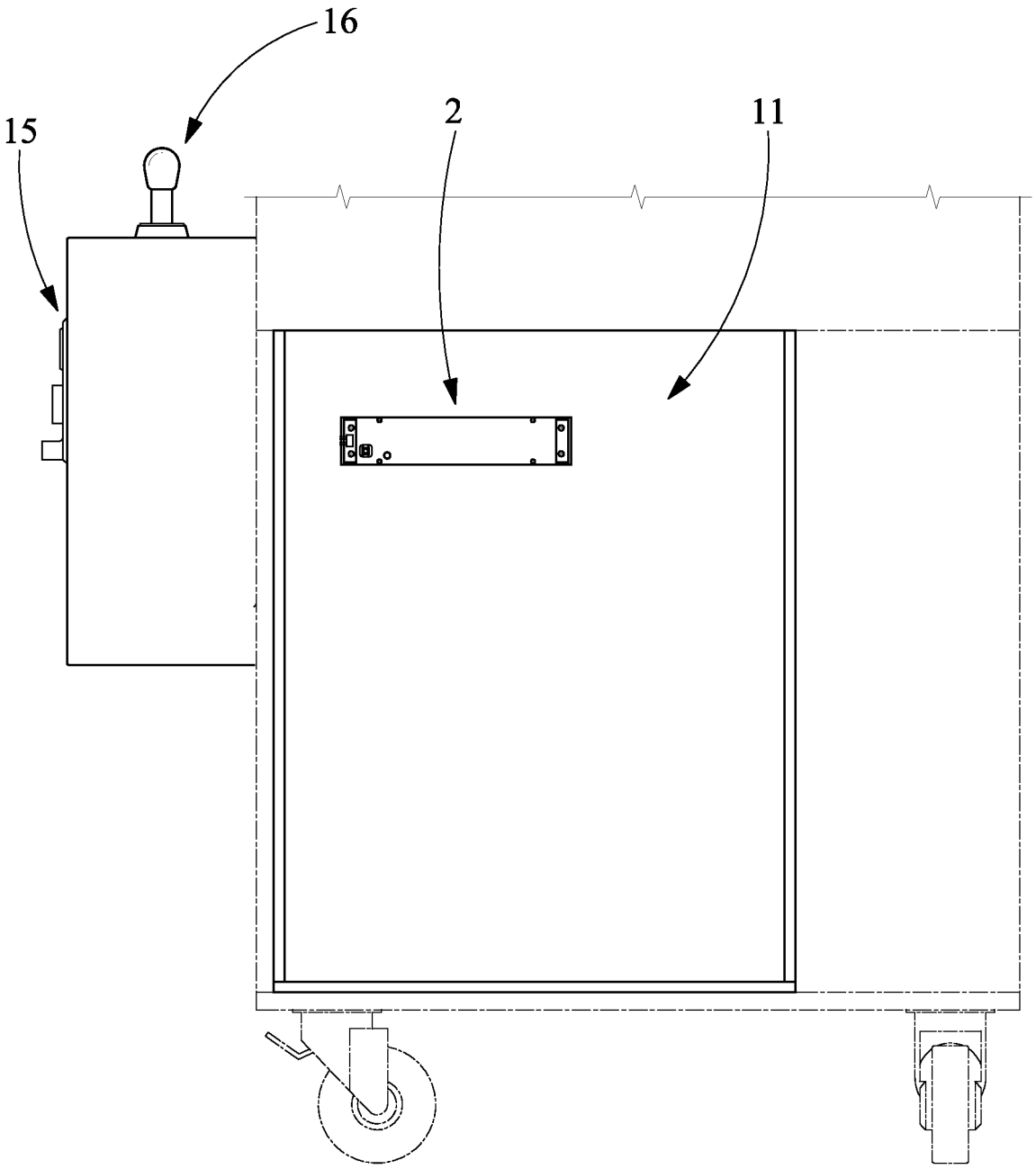
FIG. 4 is a right side view of the claw machine shown in FIG. 1.
Figure 5:
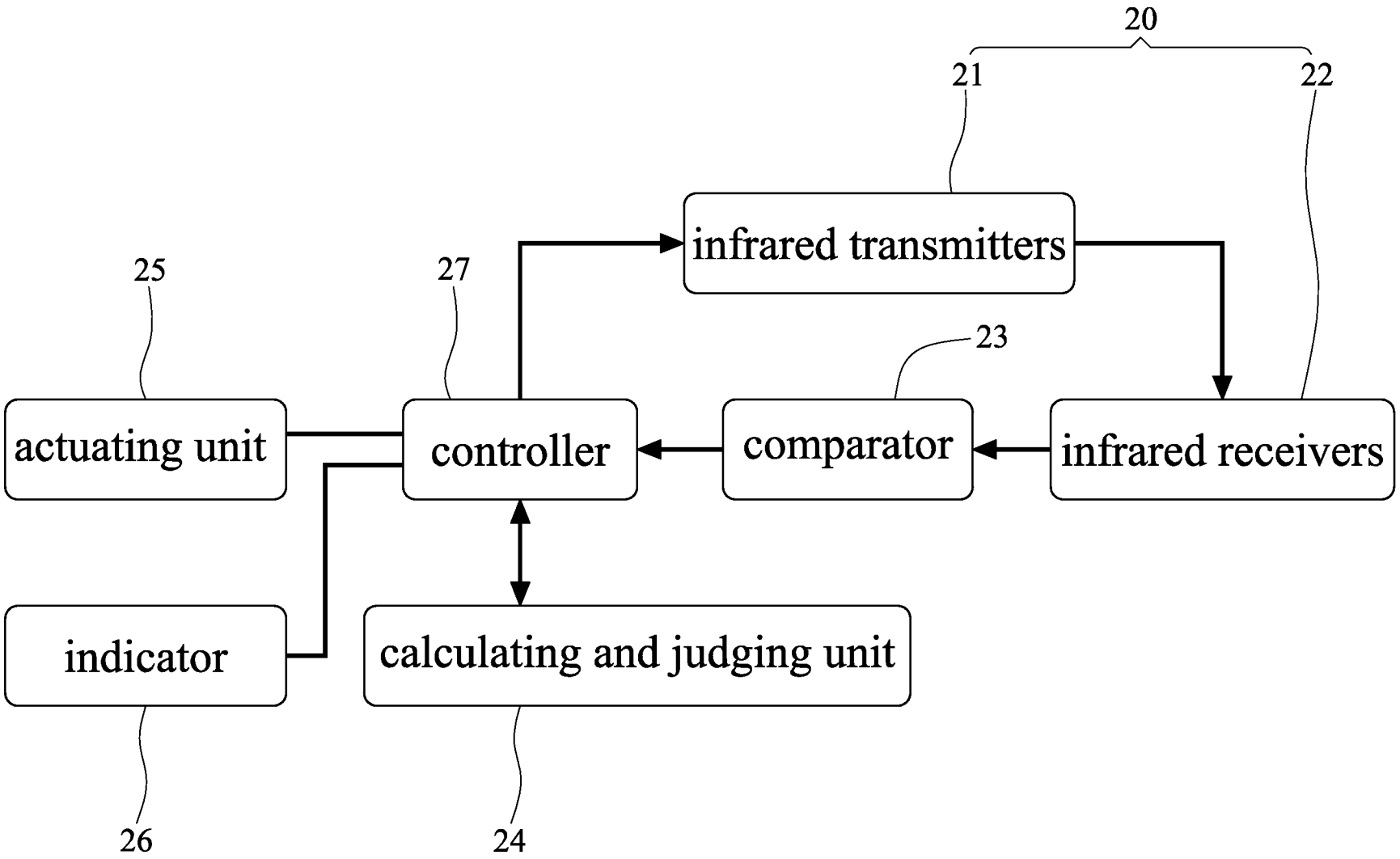
FIG. 5 is a block diagram of the apparatus for detecting a won prize shown in FIG. 1.
Figure 6:
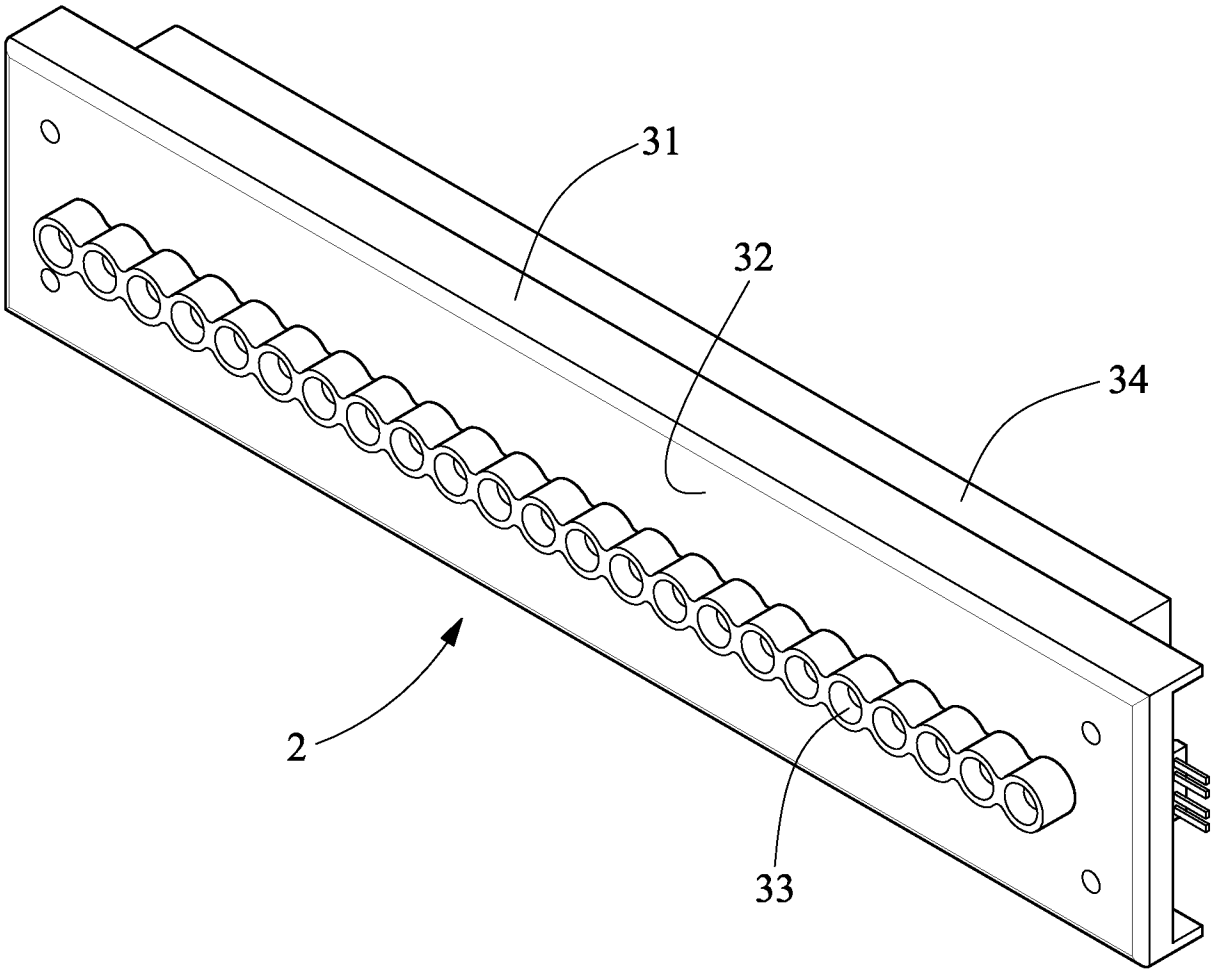
FIG. 6 is a front perspective view of the apparatus for detecting a won prize shown in FIG. 1.
Figure 7:
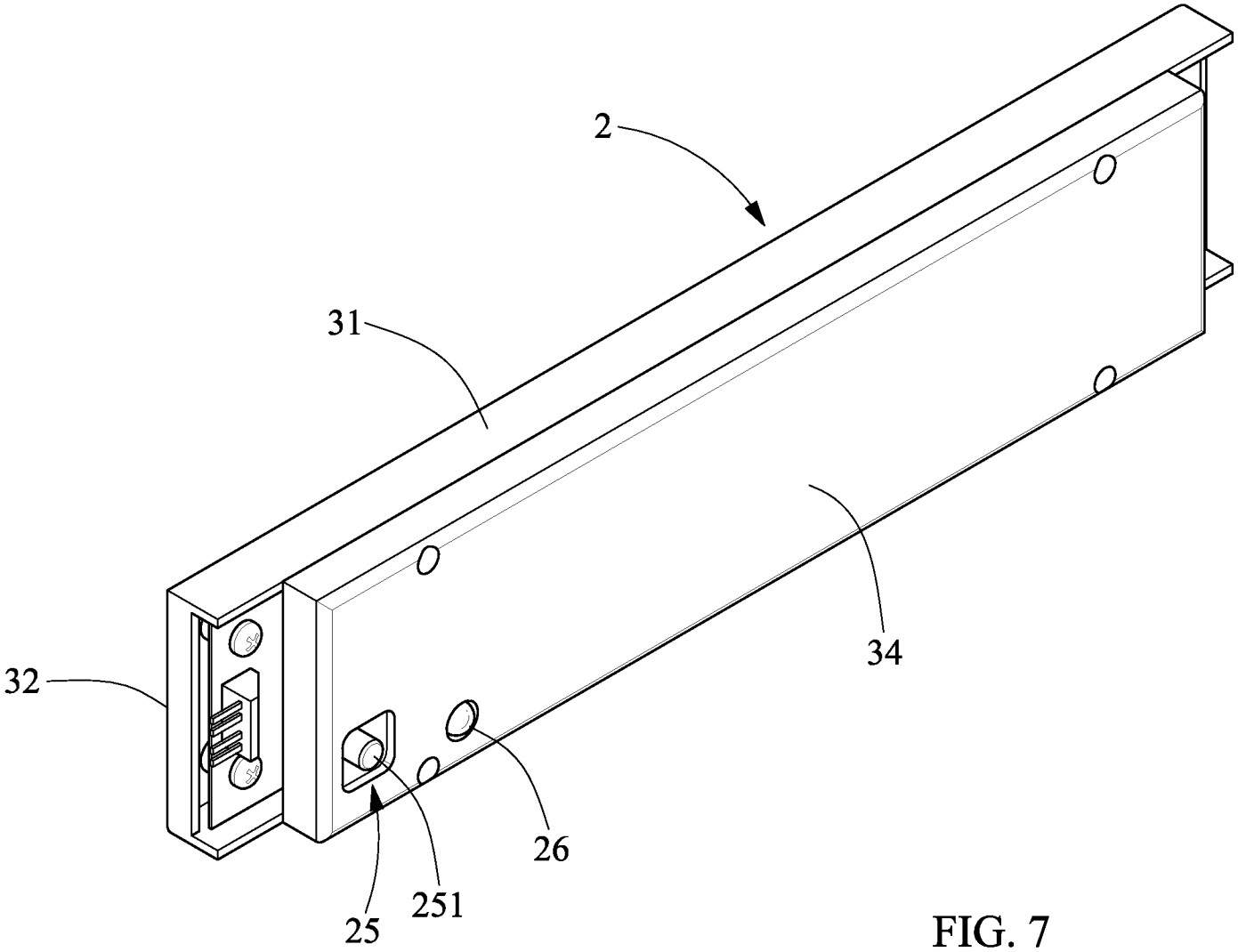
FIG. 7 is a rear perspective view of the apparatus for detecting a won prize shown in FIG. 6.
Figure 8:
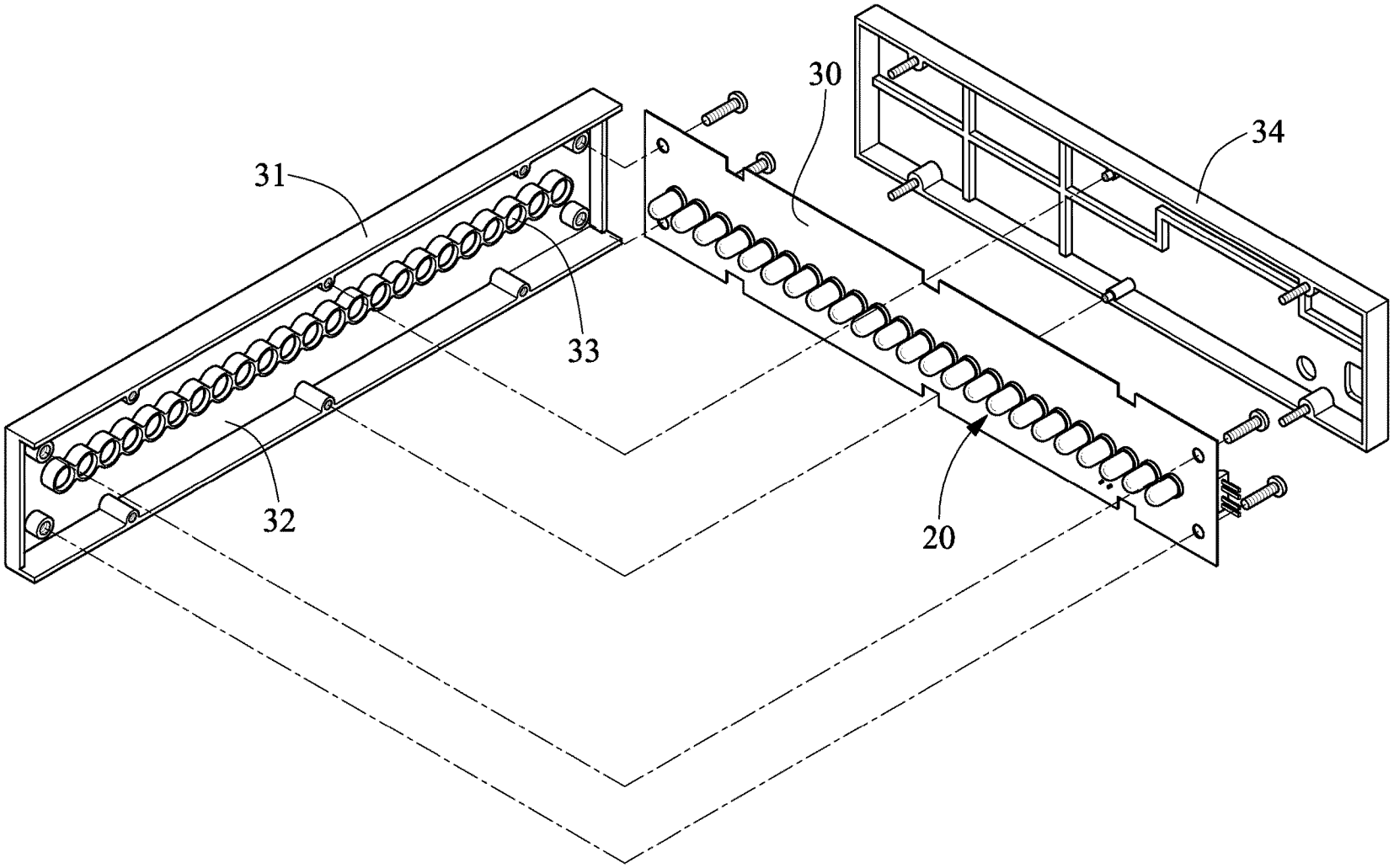
FIG. 8 is a front exploded view of the apparatus for deter ng a Avon prize shown in FIG. 6.
Figure 9:
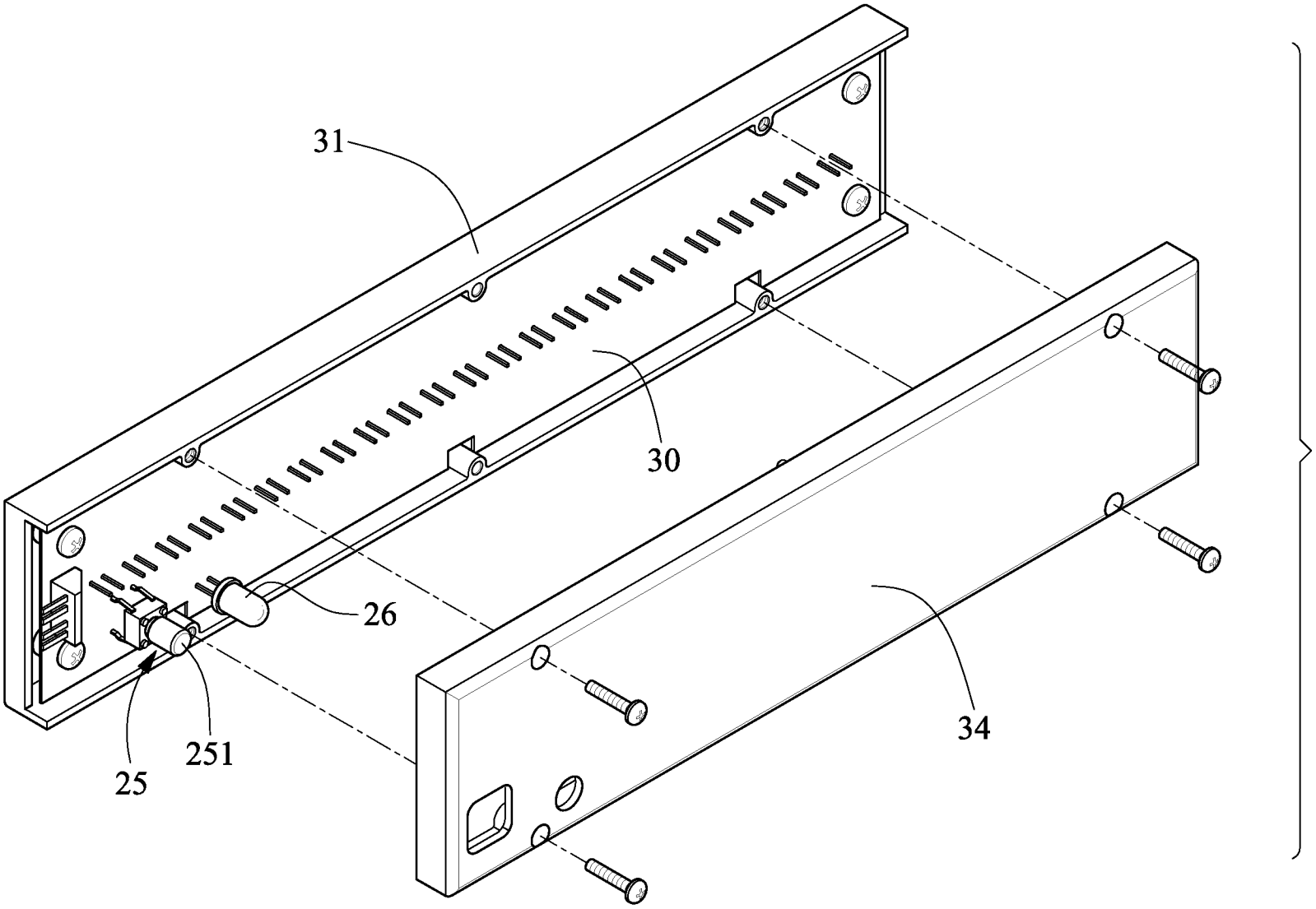
FIG. 9 is a rear exploded view of the apparatus for detecting a won prize shown in FIG. 8.
Figure 10:
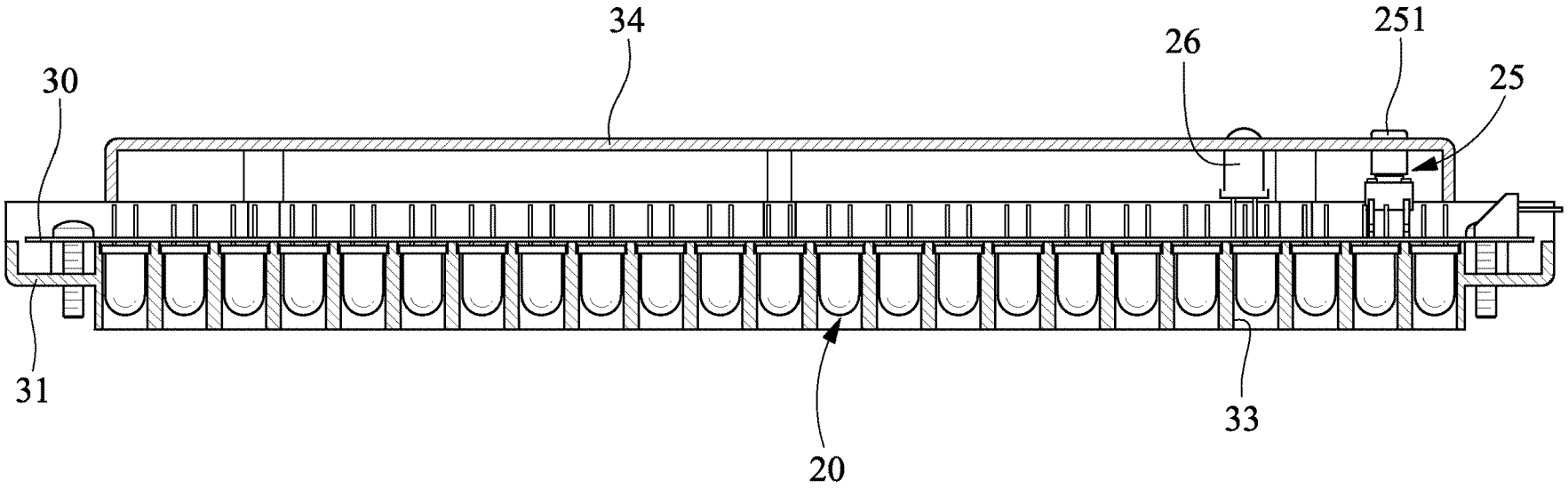
FIG. 10 is a cross-sectional view of the apparatus for detecting a won prize shown in FIG. 6.

Referring to FIGS. 1 through 5, a claw machine 10 includes a booth 12, a crane 13, a claw 14, a coin module 15, a maneuver module 16 and a sensor 2 according to the preferred embodiment of the present invention. The booth 12 includes a chute 11. The sensor 2 is attached to a wall of the chute 11 of the claw machine 10. Multiple prizes are located in the booth 12 in use. The crane 13 and the claw 14 are movable in the booth 12. The coin module 15 is located on a front face of the booth 12, and so is the maneuver module 16. The maneuver module 16 includes a joystick 161 and a button 162. The coin module 15 receives at least one coin from a player and accordingly actuates (or "wakes up") the claw machine 10. In a limited period of time, the player is allowed to operate the joystick 161 and the button 162 to move the crane 13 and the claw 14 to grasp one of the prizes and then move the grasped (or "won") prize toward the chute 11.

The sensor 2 includes infrared units 20, a comparator 23, a calculating and judging unit 24, an actuating unit 25, an indicator 26, and a controller 27. The infrared units 20 work with a carrier wave at a predetermined frequency such as 30 to 60 KHz. Each of the infrared units 20 includes infrared transmitter 21 and infrared receiver 22. The actuating unit 25 includes a button 251. The indicator 26 is preferably a light-emitting diode for emitting light of various colors in a steady or flashing manner. The foregoing elements of the sensor 2 are electrically connected to the controller 27 so that the former are instructed, controlled, commanded and managed by the latter.

Referring to FIGS. 6 through 10, the infrared units 20, the comparator 23, the calculating and judging unit 24, the actuating unit 25, the indicator 26 and the controller 27 are provided on or in an integrated circuit board 30. The integrated circuit board 30 is supported on a casing 31 that includes a front panel 32 and a back plate 34. The front panel 32 is made with apertures 33 for receiving the infrared units 20. The button 251 of the actuating unit 25 is exposed to the exterior of the casing 31 via an aperture (not numbered) in the back plate 34. There are at least two apertures 33 arranged in a horizontal line. There are preferably 3 to 30 apertures 33, and there are accordingly 3 to 30 infrared units 20.

Referring to FIGS. 1 through 4, the casing 30, which contains the sensor 2, is supported on a wall 111 (FIG. 11) of the chute 11. The sensor 2 is energized by a power supply of the claw machine 10. The infrared units 20 are pointed at the chute 11. The infrared units 20 work in a range of 1 meter for example. The range of the operation of the infrared units 20 is larger than a width of the chute 11. The actuating unit 25 is located between the wall 111 of the chute 11 and the back plate 34 of the casing 30. However, access to the actuating unit 25 by an engineer is allowed.

There can be an additional sensor 2 supported on an adjacent wall of the chute 11. In such as case, one of the sensors 2 cast infrared beams along an X-axis, and the remaining one of the sensors 2 casts infrared beams along a Y-axis extending perpendicular to the X-axis.

Figure 11:
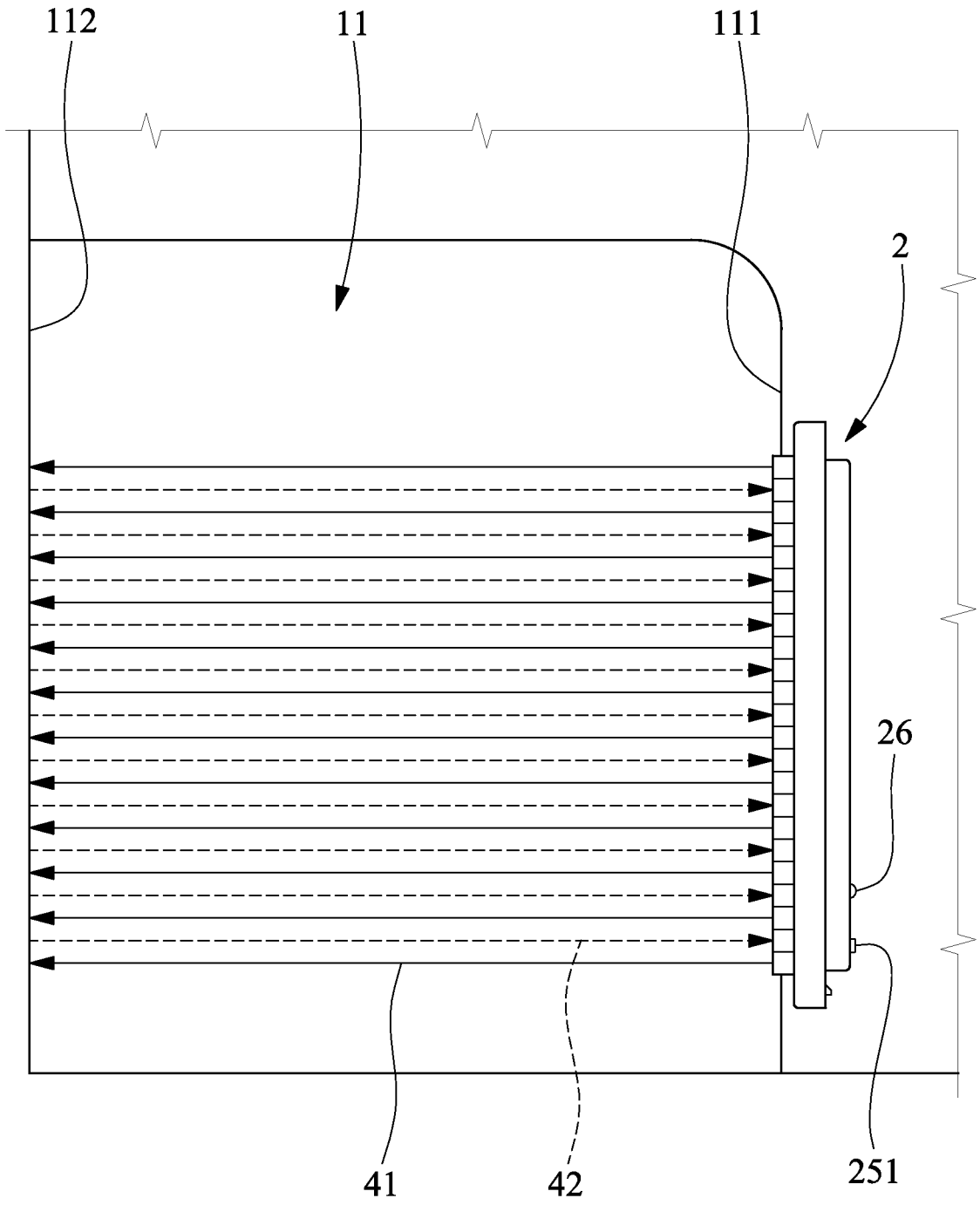
FIG. 11 is a partial view of the apparatus for detecting a won prize shown in FIG. 6 in operation.

Referring to FIGS. 11, the engineer can push the button 251 of the actuating unit 25 to execute a process for automatically diagnosing and correcting the sensor 2.

Firstly, the controller 27 instructs the indicator 26 to emit light of a first color such as yellow light in a flashing manner for example to indicate that the sensor 2 has been woken up. The controller 27 instructs the infrared transmitters 21 to cast incident infrared beams 41 with a certain carrier wave. The controller 27 adjusts the intensity of the infrared beams 41 to make sure that the incident infrared beam 41 cast from each of the infrared transmitters 21 reaches another wall 112 of the chute 11 opposite to the wall 111 (FIG. 11) and a reflected infrared beam 42 reaches the corresponding infrared receiver 22.

Secondly, the controller 27 records the period of time between the casting of the incident infrared beams 41 from the infrared transmitters 21 and the receiving of the reflected infrared beams 42 by the infrared receivers 22, and this period of time is set to be a basic period of time.

Thirdly, the comparator 23 compares the infrared receivers 22 with one another to determine whether each of them receives a reflected infrared beam 42. The process moves on if yes. Otherwise, the process returns to the first step.

Fourthly, the controller 27 commands the indicator 26 to show light of a second color such as green color to show that the diagnosis and correction have been completed.

Advantageously, with the automatic diagnosis and correction, the first step, the sensor 2 automatically adjusts the intensity and range of the incident infrared beams 41 instead of manual operation of a knob to adjust the intensity and range of infrared beams. Thus, it is ensured that each of the incident infrared beams 41 reaches the corresponding infrared receiver 22.

In addition, the incident infrared beams 41 include a certain carrier waves at a predetermined frequency to prevent other sources of light such as ambient light or decorative light of the claw machine from interfering with the infrared receivers 22. Thus, it is ensured that each of the infrared receivers 22 works accurately.

With the second step, the data are recorded as standards to determine whether a won prize has been dropped to chute 11. Alternatively, the sensor 2 does not have to been diagnosed or corrected again when the claw machine 10 is turned on again. Alternatively, the data are transmitted to other sensors 2 so that the other sensors 2 do not have to be diagnosed or corrected when they are used in claw machines 10 of the same model. Alternatively, the data can be used for other analysis to develop a new model of claw machines.

A player starts to play a round of a game with the claw machine 10 after inserting at least one coin in the claw machine 10. In a limited period of time, the player is allowed to maneuver the joystick 161 and the button 162 to move the crane 13 and the claw 14 to grasp a prize.

Firstly, the calculating and judging unit 24 determines whether the period of time taken by any of the infrared receivers 22 to receive a reflected infrared beam 42 is shorter than the basic period of time. The process goes to a second step if yes. Otherwise, the process goes to a third step.

Secondly, the calculating and judging unit 24 determines that a won prize has been dropped to the chute when the period of time taken by at least one of the infrared receivers 22 to receive the corresponding reflected infrared beam 42 is shorter than the basic period of time. Then, the calculating and judging unit 24 transmits a signal of a won prize to the controller 27. Accordingly, the controller 27 transfers the signal of a won prize to a controlling terminal (not shown) of the claw machine 10. The controlling terminal commands the claw machine 10 to open a door or gate for example to allow the player to take the won prize from the chute 11. Otherwise, the controlling terminal to move the crane 13 and the claw 14 back to their original locations.

Thirdly, the calculating and judging unit 24 determines that no prize has been dropped to the chute when all of the periods of time taken by the infrared receiver 22 to receive the reflected infrared beams 42 are identical to the basic period of time. Then, the calculating and judging unit 24 transmits a signal of void to the controller 27.

Fourthly, the controller 27 accumulates the number of signals of void that it receives. When the number of signals of void reaches a certain value, the controller 27 transmits a signal of guaranteed grasp to the controlling terminal of the claw machine 10. Then, the controlling terminal commands the claw machine 10 to execute a mandatory grasping process to successfully release a won prize from the booth 12 through the chute 11.

The present invention has been described via the illustration of the preferred embodiment. Those skilled in the art can derive variations from the preferred embodiment without departing from the scope of the present invention. Therefore, the preferred embodiment shall not limit the scope of the present invention defined in the claims.

The invention claimed is:

1. A claw machine comprising:

a chute for delivering a prize from the claw machine; and at least one sensor comprising:

infrared units each of which comprises an infrared transmitter for emitting an incident infrared beam with a carrier wave at a predetermined frequency and an infrared receiver for receiving a reflected infrared beam at the predetermined frequency;

a comparator;

a calculating and judging unit;

an actuating unit comprising a button;

an indicator for emitting light of various colors in various ways;

a controller for instructing, controlling, commanding and managing the infrared units, the comparator, the calculating and judging unit, the actuating unit and the indicator;

an integrated circuit board, wherein the infrared units, the comparator, the calculating and judging unit, the actuating unit and the indicator are supported on the integrated circuit board; and a casing for containing the integrated circuit board, wherein the casing comprises a front panel and a back plate connected to the front panel, wherein the front panel comprises apertures for receiving the infrared units, wherein the button of the actuating unit is exposed from the casing via the back plate, wherein the casing, which contains the integrated circuit board, is supported on a wall of the chute.

2. The claw machine according to claim 1, wherein the predetermined frequency is 30 to 60 KHz.

3. The claw machine according to claim 1, wherein the infrared units are supported on the integrated circuit board along a horizontal line.

4. The claw machine according to claim 1, wherein the sensor comprises 3 to 30 infrared units.

5. The claw machine according to claim 1, comprising two sensors, wherein one of the sensors casts infrared beams parallel to an X-axis of the chute, wherein the other one of the sensors casts infrared beams parallel to a Y-axis extending perpendicular to the X-axis.

* * * * *